United States Patent [19]

Babendererde et al.

[11] Patent Number: 4,789,267

[45] **Date of Patent: * Dec. 6, 1988**

[54] METHOD OF AND APPARATUS FOR CONCRETE TUNNEL LINING

[75] Inventors: Siegmund Babendererde, Bad Vilbel; Bernd Hillemeier, Wiesbaden; Otto Braach, Hattingen, all of Fed. Rep. of Germany

[73] Assignee: Hochtief Aktiengesellschaft Vorm. Gebr. Helfmann, Essen, Fed. Rep. of Germany

[ * ] Notice: The portion of the term of this patent subsequent to Aug. 18, 2004 has been disclaimed.

[21] Appl. No.: 17,189

[22] Filed: Feb. 19, 1987

Related U.S. Application Data

[63] Continuation-in-part of Ser. No. 839,791, Mar. 13, 1986, Pat. No. 4,687,374.

[30] Foreign Application Priority Data

| | | | |
|---|---|---|---|
| Mar. 13, 1985 | [DE] | Fed. Rep. of Germany | 3508966 |
| Mar. 10, 1986 | [GB] | United Kingdom | 8605861 |
| Mar. 26, 1986 | [DE] | Fed. Rep. of Germany | 3610237 |
| Jul. 2, 1986 | [DE] | Fed. Rep. of Germany | 3622203 |
| Dec. 24, 1986 | [DE] | Fed. Rep. of Germany | 3644532 |

[51] Int. Cl.[4] ..... E21D 9/06; E21D 11/10

[52] U.S. Cl. ..... 405/146; 264/25; 405/150

[58] Field of Search ..... 405/141, 146, 150; 219/10.55 R, 10.55 A, 10.55 M; 264/25, 31, 33; 404/95; 299/31, 33

[56] References Cited

U.S. PATENT DOCUMENTS

| | | | |
|---|---|---|---|
| 3,449,213 | 6/1969 | Knapp et al. | 264/25 |
| 3,452,176 | 6/1969 | Levinson | 264/25 |
| 3,594,530 | 7/1971 | Wiegman | 219/10.55 A |
| 3,827,244 | 8/1974 | Walbrohl | 405/141 |
| 4,018,642 | 4/1977 | Pike et al. | 219/10.55 A X |
| 4,222,681 | 9/1980 | Khodosh et al. | 405/141 |
| 4,259,560 | 3/1981 | Rhodes | 219/10.55 A X |
| 4,319,856 | 3/1982 | Jeppson | 219/10.55 A X |

FOREIGN PATENT DOCUMENTS

| | | | |
|---|---|---|---|
| 2703536 | 1/1977 | Fed. Rep. of Germany . | |
| 315709 | 11/1971 | U.S.S.R. | 264/25 |
| 527407 | 6/1977 | U.S.S.R. | 264/25 |

*Primary Examiner*—David H. Corbin
*Attorney, Agent, or Firm*—Herbert Dubno

[57] ABSTRACT

An apparatus for making a tunnel lining from concrete in a single operation with a tunnel excavator comprises a tunnel lining form consisting of a plurality of tunnel lining form segments and a form front adjacent the tunnel excavator and a tunnel lining circular space between the form and the ground. The concrete is selected so that it remains workable for more than two hours at a temperature of about 20° C. but sets to a nonworkable state after 10 to 30 minutes upon heating to a temperature in the range of substantially 40° C. to substantially 70° C. The concrete is heated in a pipe section proximal to the compartment into which it is introduced by direct introduction of electrical energy into the pipe section.

14 Claims, 5 Drawing Sheets

METHOD OF AND APPARATUS FOR CONCRETE TUNNEL LINING

CROSS REFERENCE TO RELATED APPLICATIONS

This application is a continuation-in-part of Ser. No. 06/839,791 filed 3-13-86, now Pat. No. 4,687,374. This application is also considered to be related to the commonly owned applications:

| U.S. Ser. No. | Filed | U.S. Pat. No. |
|---|---|---|
| 06/697,786 | 4 Feb. 1985 | 4,629,255 |
| 06/726,585 | 23 Apr. 1985 | 4,613,258 |
| 06/690,163 | 10 Jan. 1985 | 4,640,646 |
| 06/674,895 | 26 Nov. 1984 | 4,627,765 |
| 06/673,775 | 21 Nov. 1984 | 4,621,948 |

and U.S. Pat. No. 4,568,202 issued Feb. 4, 1986, and the still pending application Ser. No. 06/717,824 filed March 29, 1985, now U.S. Pat. No. 4,645,378, and the citations contained therein.

FIELD OF THE INVENTION

Our present invention relates to a method of making a concrete tunnel lining in a single tunnel excavating operation with a tunnel excavator, for example a shield tunnel excavator. Our invention also relates to an apparatus for carrying out the process.

BACKGROUND OF THE INVENTION

It is known to produce a concrete tunnel lining with the aid of a tunnel form comprising a plurality of tunnel form segments around which a circular space is provided, which is closed by a form front at its front end next to the tunnel excavator and at its opposing rear end by the hardened or progressively hardening concrete of the tunnel lining.

Into the tunnel lining circular space, concrete is pumped as the form front advances.

The tunnel form segments are repositioned following the progressing tunnel excavator after hardening of the concrete. Upon removal of a segment, the strength of the freshly formed concrete should be such that the concrete can already stand alone and withstand the weight of the surrounding structure without the removed form.

The strength of the freshly formed concrete add its setting rate is however dependent on the composition of the concrete and can be adjusted with suitable additives.

In any case, after hardening of the concrete to an adequate strength, the tunnel form can be repositioned. This hardening usually requires many hours. Generally the hardening spreads from the rear end of the tunnel lining circular space into the concrete which is pumped in at a later time.

The form elements or rings constituted of the tunnel form segments are repositioned starting with the rearmost section to follow the progressing tunnel excavator.

In practice, a tunnel form of 20 to 50 m in length must always remain. Because of this length, necessary to ensure that a self-supporting lining of concrete is formed, a sliding form cannot be used. Attempts to use sliding forms in constructing a concrete tunnel lining have failed for the most part.

A heating treatment for promoting the hardening of concrete to a sufficient strength is already known. These known treatments, however, have not been successful with tunnel lining. In one known process for making a tunnel lining according to German Open Patent Application DE-OS 27 03 536, only the region near the form is heated. The heat is supplied to the concrete by comparatively slow conduction through the metal shell. Also the hardening occurs from the form side to the interior of the concrete which is disadvantageous.

OBJECTS OF THE INVENTION

It is an object of our invention to provide an improved process for making a concrete tunnel lining whereby prior art drawbacks can be obviated.

It is also an object of our invention to provide an improved apparatus for making a concrete tunnel lining.

It is also another object of our invention to provide an improved process and apparatus for making a concrete tunnel lining which permits a shorter length tunnel form than earlier systems.

It is yet another object of our invention to provide an improved process and apparatus for making a concrete tunnel lining in which the tunnel form members can be quickly repositioned or a continuous form can be used.

It is still another object of our invention to provide an improved process and apparatus for making a concrete tunnel lining in which the concrete in the circular space for the tunnel lining is hardened much more quickly to a sufficient strength.

A further object of this invention is to improve upon the method and apparatus described in principle in our copending application Ser. No. 06/839,791.

SUMMARY OF THE INVENTION

These objects and others which will become more readily apparent hereinafter are attained in accordance with our invention in a process for making a tunnel lining from concrete in a single operation with a tunnel excavator.

The tunnel lining circular space is provided with the help of a tunnel form consisting of a plurality of tunnel form segments, and the tunnel lining circular space is closed by a form front at a front end adjacent the tunnel excavator and at a rear end of the tunnel form by already hardened concrete.

The process comprises pumping in the concrete in fluid form through the form front, accelerating the hardening of the concrete by electromagnetic wave heating and repositioning the tunnel form segments following the tunnel excavator after hardening the concrete to a sufficient strength.

The above and other objects are also attained in an apparatus for making a concrete tunnel lining in a single operation with a tunnel excavator comprising a tunnel lining form consisting of a plurality of tunnel lining form segments connected to and following the tunnel excavator and a form front adjacent the tunnel excavator and a tunnel lining circular space between the form and the ground.

According to the process of our invention, the concrete being conducted into the tunnel lining circular space and/or in the tunnel lining circular space is heated dielectrically with electromagnetic radiation. The heating of a dielectric material that occurs by application of an electromagnetic field is well-known. Microwave heaters and ovens are designated to utilize that effect. The penetration depth of an electromagnetic wave depends on its frequency and intensity.

Our invention, as described in our earlier application Ser. No. 06/839,791, was based on the observation that concrete is a dielectric of sufficient strength for dielectric heating as long as metal reinforcements or fiber reinforcements of metal fiber do not prevent the penetration of the electromagnetic radiation.

In the tunnel building process of the invention, the tunnel lining circular space and thus the concrete contain no such reinforcements.

It is understood that the region through which the electromagnetic radiation must penetrate or pass cannot be covered by metal, since the electromagnetic radiation cannot penetrate the metal. However, metallic components can be used in the system which transmits the electromagnetic radiation as is explained further below.

In particular, there are several possible variants of the process according to our invention. The electromagnetic radiation can be introduced into the concrete from the tunnel form. It is not necessary that the electromagnetic waves operate until the desired strength or hardness is reached. It is sufficient that a suitably uniform heating of the concrete occurs. The heating accelerates the chemical process of hardening, i.e. promotes the earlier attainment of the so-called early-hardening-strength.

The concrete flowing into the tunnel lining circular space via the input pipe can also be subjected to a dielectric heating. This can be done adjacent the form front.

The wavelength of the electromagnetic waves is continually adjusted so that the concrete in a feed pipe is heated dielectrically in bulk through the entire diameter of the feed pipe. Also the intensity of the electromagnetic radiation may be suitably adjusted. The wavelength of the electromagnetic radiation can be changed to vary the depth of penetration of the radiation.

Particularly when the electromagnetic radiation from the tunnel form is introduced into concrete, we are able to effect a penetration which is so deep that a dielectric heating occurs even into the surrounding ground so that the heating of the concrete is very uniform. Consequently a very uniform hardening occurs.

Generally it is sufficient to tune the system so that the electromagnetic waves penetrate only into a region in the concrete close to or connected to the form front and heat the layer over its full thickness or only a part of it. Specifically a heating of from 0.5 to 5 minutes is sufficient.

Advantageously in another embodiment, the heating proceeds long enough so that an early hardening strength of 30 kp $cm^2$ results. In pumping concrete with an aggregate commonly used for a tunnel lining, electromagnetic wave frequencies of 20 to 40 MHz can be used effectively. Furthermore, a concrete with an electromagnetic additive which influences the strength of hardness can be subjected to dielectric heating in a tunnel form according to our invention.

In the apparatus, according to our invention, inductive and/or capacitative transmitting antennae for the electromagnetic radiation are built in, preferably into or on the tunnel form segments. Transmitting antennae adjacent each other are appropriately driven counterphasally (i.e. electrically 180 out-of-phase).

Another apparatus for performing the process has at least one feed pipe for concrete having inductive and/or capacitative transmitting antennae. The feed pipe can comprise a dielectric material, for example a ceramic, so that the transmitting antennae can be mounted exteriorly.

Our invention, as described in Ser. No. 06/839,791, reduces significantly the required time to attain a sufficient hardness, i.e. increases the early hardness strength, for example, by half or more. This allows a corresponding reduction of the length of the tunnel form which remains behind the excavating machine and makes significantly easier the steps necessary to reposition the tunnel form. The tunnel form can advantageously comprise a plurality of tunnel form segments which are individually repositionable. Because of the short form, a sliding form can be used which does not require removal or repositioning of the form sections.

While our earlier application Ser. No. 06/839,791 has described in principle the use of electrical energy to heat concrete which is pumped into the compartment defined between the tunnel-form ring or rings and the tunnel wall resulting from advance of the excavator, it has been found that there are certain conditions which greatly facilitate the tunnel lining operation and element the need for inductive transmitting antennae, capacitive radiation elements and like means for introducing electrical energy into the concrete for heating purposes.

We have now found, in particular, that the concrete which is used to line the tunnel wall has a composition such that at a temperature of about 20° C., it remains workable and hence flowable for a period of more than two hours, but upon heating to a temperature in the range between 40° C. and 70° C., it sets to a nonworkable state after 10 to 30 minutes. Preferably after only about 10 minutes, significant improvement in the lining process can be obtained, especially when this concrete is heated by the direct introduction of electrical energy into the concrete, i.e. by resistance heating utilizing the resistance of the concrete itself to a temperature in the aforementioned range of 40° to 70° C. directly before it is introduced into the compartment.

After such heating, the concrete can remain workable for about 10 minutes and this has been found to allow sufficient time to emplace it along the tunnel wall in the compartment defined between it and the tunnel-formed ring.

The direct introduction of electrical energy into the concrete in the pipe through which it is pumped into the compartment has been found to ensure uniform heating of all volume elements of the flowing concrete so that the concrete is uniformly brought to the setting activation temperature without the creation of detrimental temperature gradients of a type which can result form heat-transfer techniques.

Preferably we operate with a lining concrete which is no longer workable after 15 minutes upon heating to a temperature of about 50° C.

The direct introduction of electrical energy can be effected in many ways. Mention has been made above of the use of resistance heating, i.e. heating the concrete resistively between two electrodes. However other electromagnetic waves on the injections may be used as well, i.e. injecting microwave energy into the concrete.

Apart from the usual components of the concrete, such as a hydraulic cement, sand and gravel, and concrete additives such as viscosity modifiers and retarders, steel fibers or the like can be added. Other fillers can be continuously mixed with the lining concrete as well and the additives to the concrete can be utilized to adjust the conductivity or resistance thereof so that the desired degree of electrical energy can be introduced.

The introduction of electrical energy, preferably is effected directly adjacent the leading end of the compartment, proximal to the tunnel-form ring. It can, however, be effected at a distance of several meters from the compartment as long as the velocity of the concrete is sufficient and there is sufficient time for the heated concrete to be uniformly distributed.

In accordance with the principles of the invention, the concrete is hardened in an especially short time, allowing removal of the tunnel-form ring and the other advantages developed above After thermal activation in the claimed manner, hydration heat is evolved at a rate which likewise contributes to an accelerated setting an hardening. However, should there be a failure of advance of the tunneling machine, the electrical heating can be simply cut off and durations of up to two hours or even more of such interruptions can be tolerated without premature setting of the concrete in the pipe lines and elsewhere. The entire tunneling process is greatly accelerated.

According to the apparatus aspects of the invention, the pipe fitting close to the inlet to the compartment can consist of an electrically nonconductive material and on the interior of the pipe segment, a pair of juxtaposed electrodes can be provided and which can be connected through terminals passing through the nonconductive wall to a transformer supplied with line current or to another electrical energy source such as a generator.

Preferably alternating current is applied.

In another embodiment of the invention, the tube can be composed of an electrically nonconductive material and can be provided with an inductive or capacitive antenna connected in turn with a proper transmitter.

The electrical energy which is supplied should be coordinated with the volume rate of flow of the lining of the concrete and in accordance with this principle, the energy supply means can be provided with a control or regulating unit which permits adjustment of the electrical energy in accordance with the volume flow rate, the temperature of the concrete before heating and the predetermined desired heated concrete temperature. The tube length and the fitting provided with the electrodes or like heating means can be varied as required.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
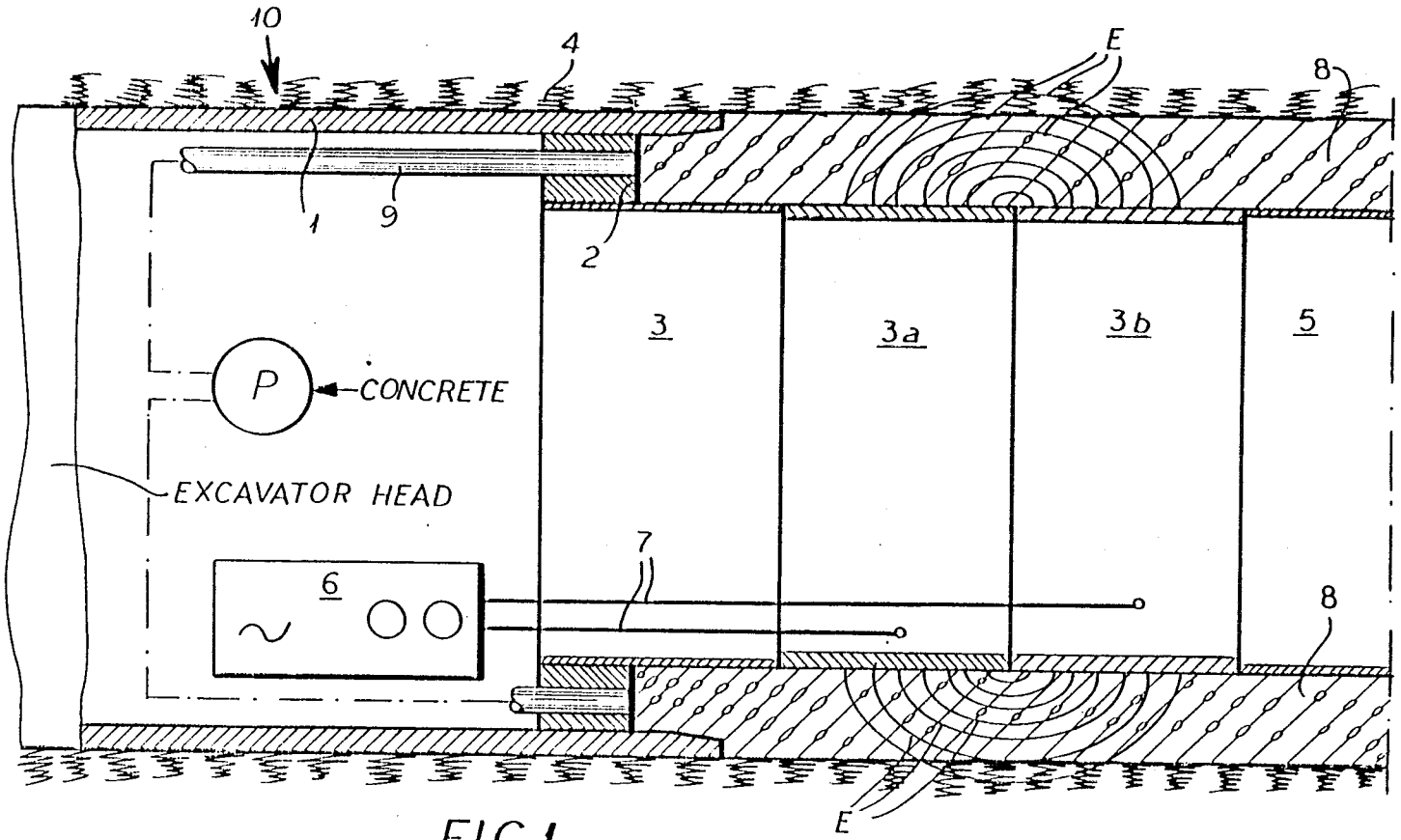
FIG. 1 is a longitudinal cross sectional view of an apparatus for making a concrete tunnel lining according to our invention.
Figure 2:
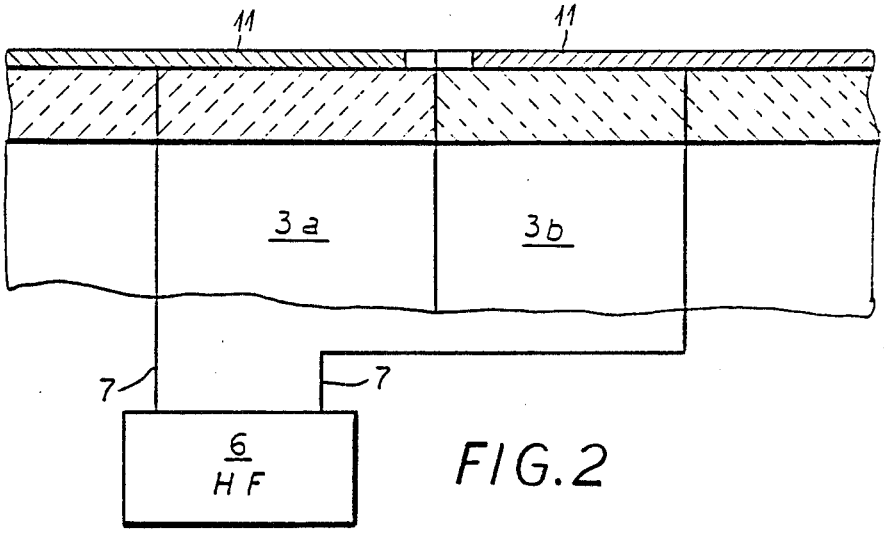
FIG. 2 is a detail of the wall of the heating region.
Figure 3:
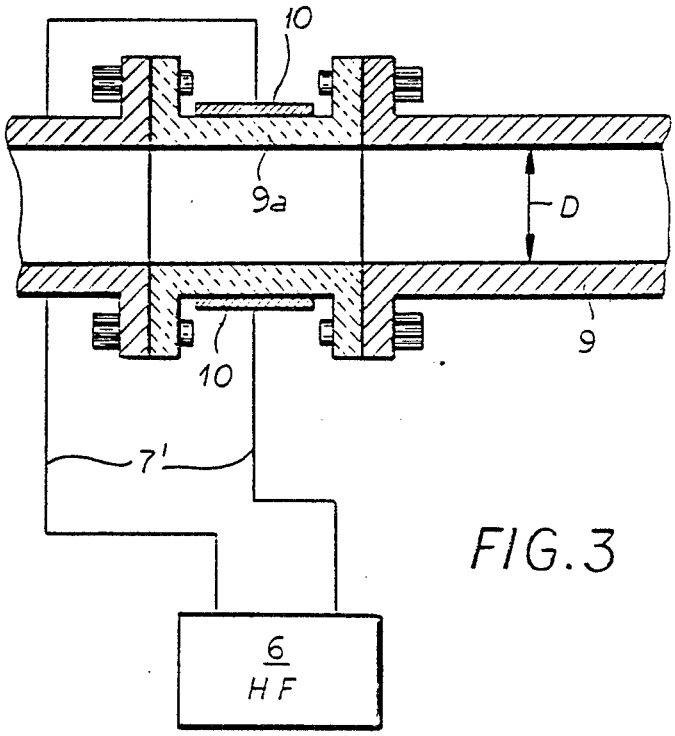
FIG. 3 is a section through the concrete feed pipe.

We have shown a shield extension 1 of a tunnel excavator (see the aforementioned application), and a form front 2 connected with a tunnel form consisting of a plurality of tunnel form segments 3, 3*a*, and 3*b*. One also sees the tunnel casing 5 in the surrounding subterranean structure 4.

The tunnel form segments of ceramic 3*a* and 3*b* have integrated antennae 11. They are driven electrically in phase opposition by a transmitter 6 having an output in the 20 to 40 MHz range. They are connected to transmitter 6, of course by the shielded cables 7.

The concrete 8 is pumped into the tunnel lining circular space 12 between tunnel form 3 and the ground 4 to form the tunnel lining 15. The feed pipe 9 having a diameter D serves for delivery of the concrete 8 behind form front 2. When the transmitter 6 is switched on, an electromagnetic field arises having high frequency electric field lines E and a corresponding alternative magnetic field, which penetrates into the concrete 8 of the tunnel lining 15, and if the power and frequency are so adjusted, also a little way into the surrounding ground 4. As a result, the concrete 8 and the surrounding ground 4 are heated dielectrically and the hardening of the concrete 8 is considerably accelerated. The form can be moved when the heating results in a strength of 30 kp/cm$^2$. The dielectric heating of the concrete 8 can be commenced when it is still in part of the feed pipe 9 using one or more transmitting antennas 10 connected to transmitter 6 by cable 7' and mounted on a ceramic segment 9*a* of the pipe.

Figure 4:
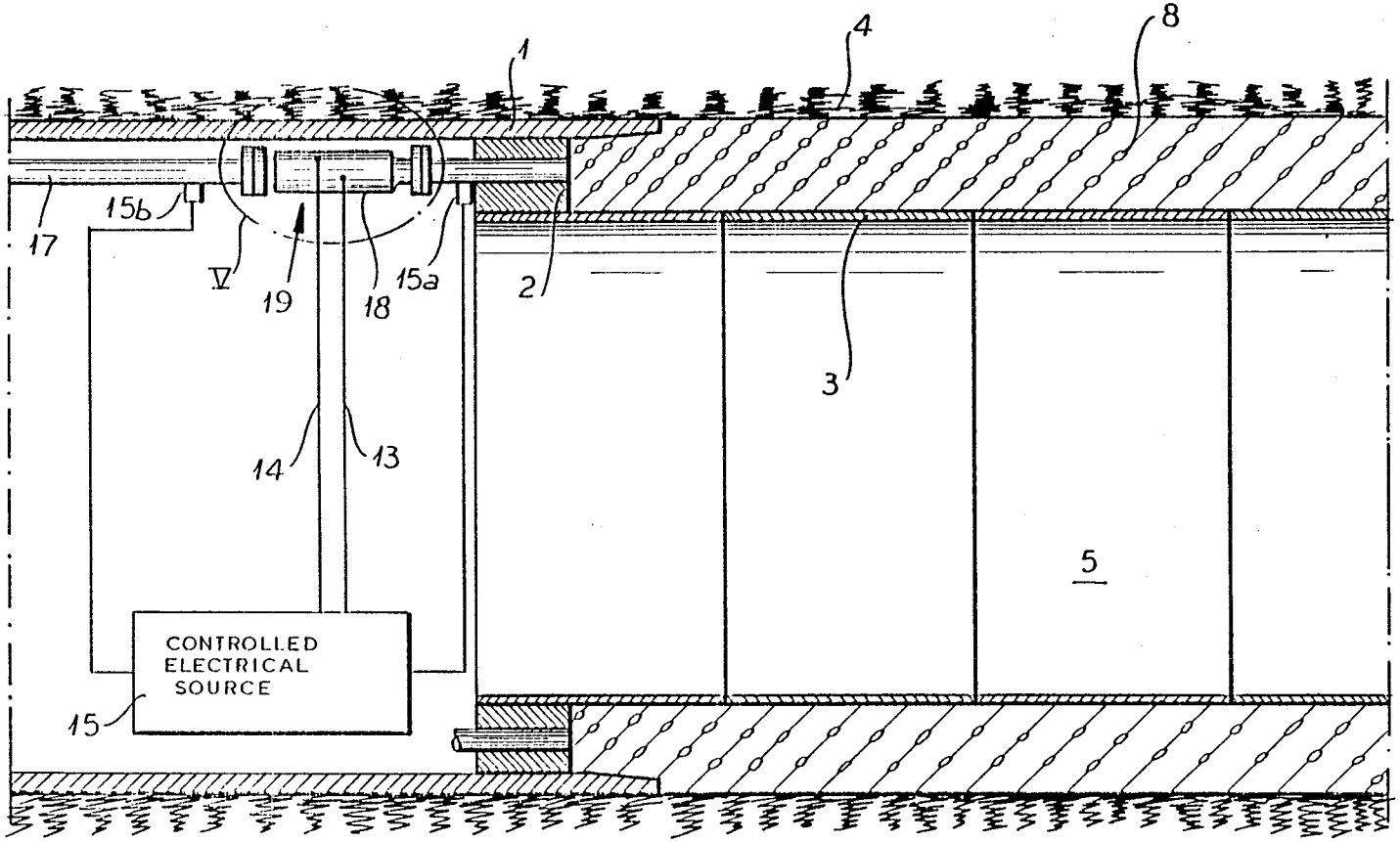
FIG. 4 is a view similar to FIG. 1 illustrating principles of the present improvement.

In FIG. 4, which is generally similar to FIG. 1, the end 1 which constitutes the bracing shield of a tunneling machine or excavator head, which is not otherwise illustrated, and is displaced to the left in this Figure, defines a compartment which is filled with concrete as the tunneling machine advances, the compartment being bounded by an end form ring 2, which advances with the machine and a number of tunnel form rings 3 which have been illustrated as complete rings but are normally formed from segments enabling them to be disassembled if desired or to remain in the place.

The tunnel pipe 5 is represented beyond the rings 3 which are spaced from the tunnel wall 4 formed by excavation and the compartment 6 is shown to be filled with concrete.

In this embodiment, the concrete supply pipe 17 can be seen to open through the ring 2 into the compartment 6 and is provided close to the point at which it opens into this compartment with a pipe section 18 in which, by direct introduction of electrical energy, the concrete is heated. The heating unit has been designated generally at 19.

The concrete which is pumped into the compartment 6 has a composition such that when it is heated to 40° to 70° C. and preferably 50° to 60° C. in the heating unit 19, setting will occur to a nonworkable state within 10 to 30 minutes and preferably about 15 minutes.

Temperature measuring units can be provided, e.g. as shown at 15*a*, to measure the temperature of the heated concrete and at 15*b* to measure the temperature of the concrete before heating and means (not shown) can be provided to add steel fibers or the like to the concrete in order to vary the conductivity as required to obtain the desired temperature level.

Figure 5:
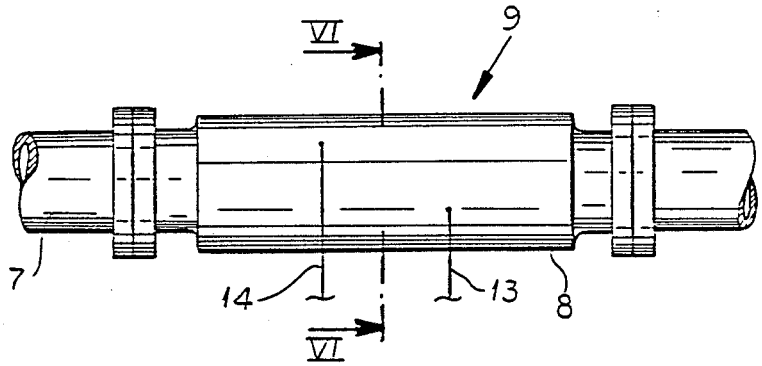
FIG. 5 is a detail view of the region V of FIG. 4.
Figure 6:
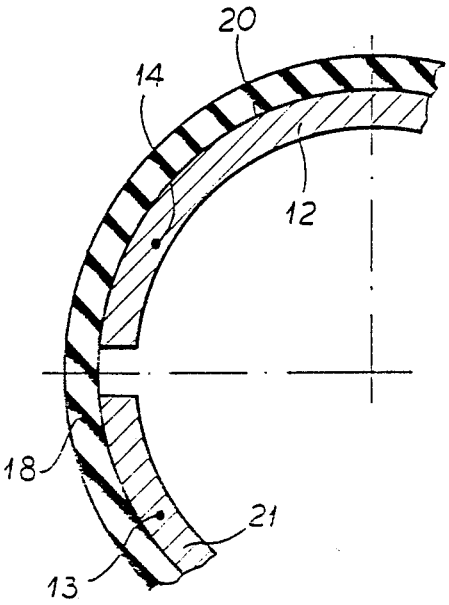
FIGS. 6 and 7 are sectional views taken generally in a plane represented by the section line VI—VI of FIG. 5 showing two embodiments of the heating tube section according to the invention.

As is apparent from FIGS. 5 and 6, as well as the reference to FIG. 4, the direct electric heating is a resistance heating between electrodes 21 and 12, each of which can be applied with one terminal of an alternating current source 15 having a controlled output. The conductors 13 and 14 which are connected to the electrodes 21 and 12 lie along the inner wall 20 of an insulating pipe section 18 as can be seen in FIG. 6. The conductors 13 and 14 can represent respective phases of the alternating current supply and if a three-phase transformer is used, each phase can be applied to one of three electrode segments 21, 12 . . . which are disposed in an angularly offset relationship through 120° about the axis of the pipe.

Figure 7:
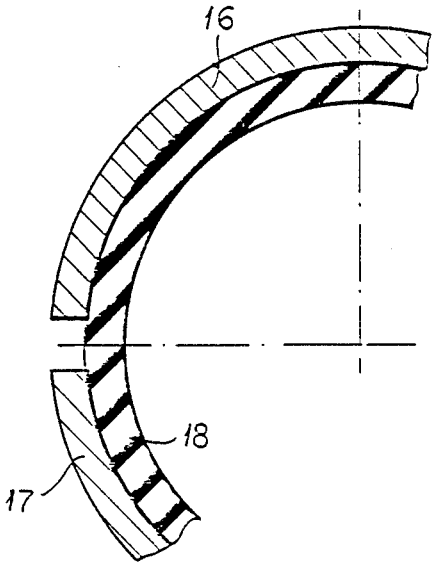

A dielectric heating arrangement is visible in FIG. 7 and in this case the tube section 18 is provided inductive and/or capacitative transmitting antennae 16, 17 which are connected with appropriate transmitters to effect dielectric heating of the concrete in the manner previously described.

Figure 8:
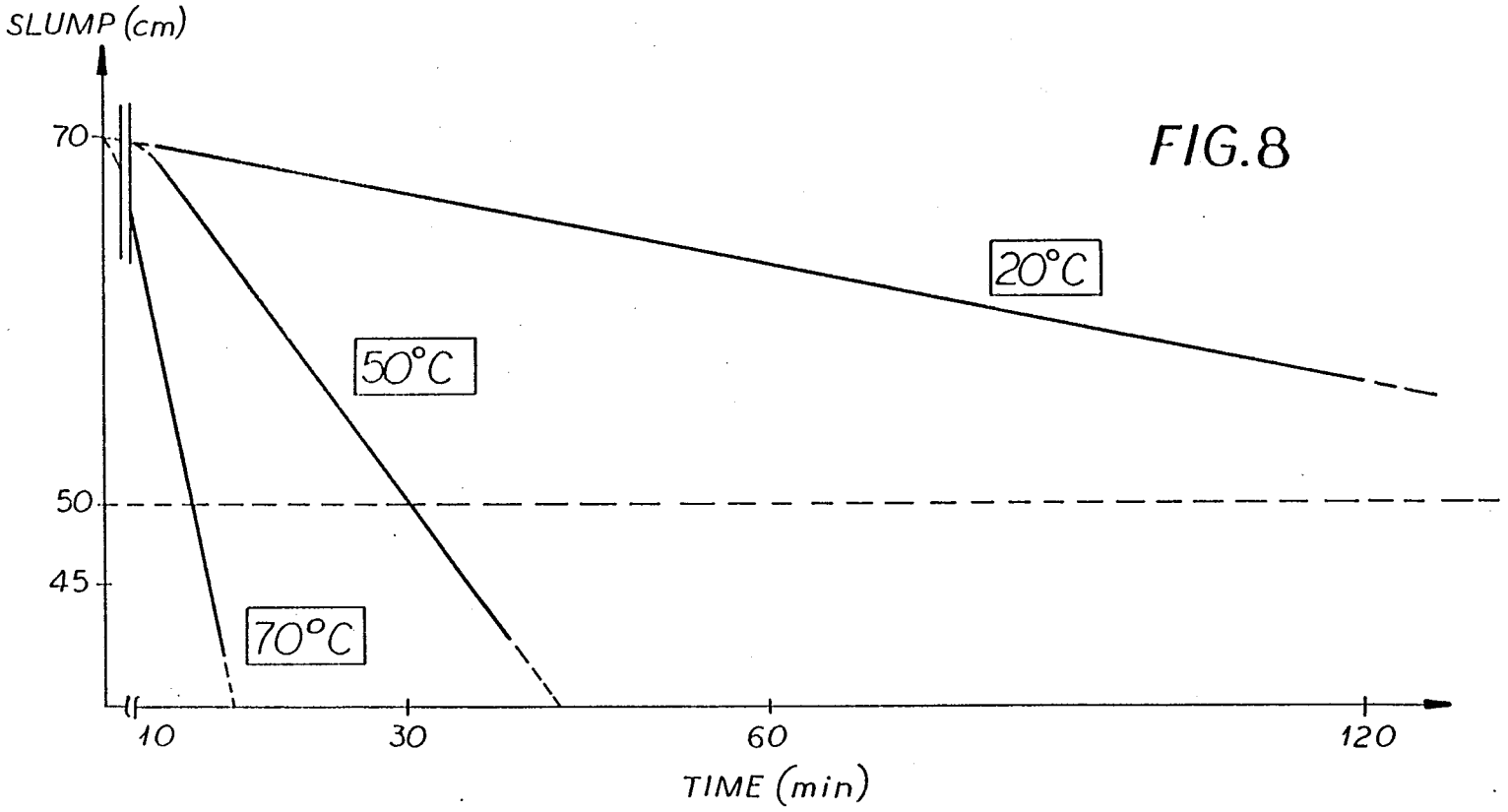
FIG. 8 is a graph illustrating principles of the present invention.

The graph of FIG. 8 has a time (in minutes) plotted along the abscissa against the slump (in cm) plotted along the ordinate, the slump being measured in accordance with the German Industrial Standard DIN.

The slump is, of course, a measurement of the softness of the concrete and hence the workability thereof, the test involving casting a cone of the unhardened concrete and permitting the cone to settle. The diameter of the spread is measured and represented at the ordinate.

When the concrete no longer flows, it is considered in a transition state between the end of workability and the beginning of hardening. Further transition toward the hardened state proceeds rapidly. The concrete as it is used in accordance with the invention is heated to the point that upon entering the compartment which is still in a condition between a workable state and the end of workability, as described above. As the graph shows, when the concrete is heated to a temperature to say 20° C., the concrete does not reach the broken line level representing, effectively, a lack of workability within 120 minutes. However, when the concrete is heated to 50° C., it can reach this point within 30 minutes, and a much shorter period is required. The concrete is heated to 70° C. The time between the end of workability and the beginning of hardening at 20° C. can be between 21 and 4 hours. The concrete of the invention after two hours already has a strength of 5 $N/mm^2$, and a strength of 10 $N/mm^2$ after four hours.

We claim:

1. A method of forming a tunnel, comprising the steps of:

advancing a tunneling machine through a subterranean structure to excavate material and form a tunnel wall behind the advance of said tunneling machine;

behind the advance of said tunneling machine, spacedly juxtaposing with said wall a tunnel-form ring to define with said wall an annular compartment which is formed progressively with the advance of the machine;

pumping into said compartment a concrete having a composition selected such that it remains workable for more than two hours at a temperature of about 20° C. but sets to a nonworkable state after 10 to 30 minutes upon heating to a temperature in a range of substantially 40° C. to substantially 70° C.;

heating the concrete pumped into said compartment at a location proximal to that at which the concrete enters said compartment by the direct introduction of electrical energy into the pumped flow of concrete to a temperature in said range of substantially 40° C. to substantially 70° C.; and permitting the heated concrete to set in said compartment so as to form a concrete tunnel lining which advances with the advance of said machine.

2. The method defined in claim 1 wherein the concrete has a composition such that upon heating to about 50° C., it is no longer workable after about 15 minutes.

3. The method defined in claim ; wherein the concrete is heated by introducing electromagnetic waves into the concrete.

4. The method defined in claim 1 wherein the concrete is heated by applying an electric field between a pair of electrodes.

5. The method defined in claim 1 wherein the concrete comprises in addition to hydraulic cement, sand, gravel, water, viscosity modifiers and retarder, a quantity of steel fibers.

6. The method defined in claim 1 wherein said concrete comprises hydraulic cement, sand, gravel, water and at least one filler selected from the group which consists of stone meal, fly ash and silica powder.

7. An apparatus for forming a tunnel comprising:

a tunneling machine for advancing a tunnel through a subterranean structure to excavate material and form a tunnel wall behind the advance of said tunneling machine;

at least one tunnel-form ring disposed behind the advance of said tunneling machine to define with said wall an annular compartment which is formed progressively with the advance of said machine;

means including a pipe opening into said compartment for pumping into said compartment concrete having a composition such that it remains workable for more than two hours at a temperature of 20° C. but sets to a nonworkable state after 10 to 30 minutes upon heating to a temperature in a range of substantially 40° C. to substantially 70° C.; and means including a pipe section of said pipe proximal to said compartment for directly introducing electrical energy into the pumped flow of concrete traversing said pipe to heat said concrete to a temperature in said range of substantially 40° C. to substantially 70° C. whereby said concrete is permitted to set in said compartment so as to form a concrete tunnel lining which advances with the advance of said machine.

8. The apparatus defined in claim 7 wherein said pipe section includes a nonconductive tubular wall formed on its inner surface with electrodes adapted to contact the concrete, and conductors connected to said electrodes for applying an electrical field thereacross.

9. The apparatus defined in claim 7 wherein said pipe section comprises an electrically nonconductive tube traversed by said concrete and at least one inductive or capacitive antenna on said tube connected with a transmitter.

10. The apparatus defined in claim 7 wherein a controlled electrical source is connected with said pipe section for adjusting the electrical energy introduced into said concrete in response to at least one parameter from:

a. the temperature of the concrete entering said pipe section;

b. the temperature of the concrete leaving said pipe section; and c. the volume rate of flow of the concrete through the pipe.

11. An apparatus for forming a tunnel comprising:

a tunneling machine for advancing a tunnel through a subterranean structure to excavate material and form a tunnel wall behind the advance of said tunneling machine;

at least one tunnel-form ring disposed behind the advance of said tunneling machine to define with said wall an annular compartment which is formed progressively with the advance of said machine;

means including a pipe opening into said compartment for pumping concrete into said compartment, said pipe having at least one electric heating pipe section; and means connected to said electric heating pipe section for directly introducing electrical energy into the pumped flow of concrete traversing said pipe to heat said concrete and promote setting thereof.

12. The apparatus defined in claim 11 wherein said pipe section includes a nonconductive tubular wall formed on its inner surface with electrodes adapted to contact the concrete, and conductors connected to said electrodes for applying an electrical field thereacross.

13. The apparatus defined in claim 11 wherein said pipe section comprises an electrically nonconductive tube traversed by said concrete and at least one inductive or capacitive antenna on said tube adapted to be coupled to a transmitter.

14. The apparatus defined in claim 11 wherein a controlled electrical source is connected with said pipe section for adjusting the electrical energy introduced into said concrete in response to at least one parameter from:

a. the temperature of a concrete entering said pipe section;

b. the temperature of the concrete leaving said pipe section; and c. the volume rate of flow of the concrete through the pipe.

* * * * *